US006485379B2

(12) United States Patent
Fondin et al.

(10) Patent No.: US 6,485,379 B2
(45) Date of Patent: Nov. 26, 2002

(54) BALL-CARRYING STRUCTURE

(75) Inventors: Gilles Fondin, Nantes (FR); Cyrille Guillot, Lantau Island (HK)

(73) Assignee: Pilou Company Limited, Hong Kong (CN)

( * ) Notice: Subject to any disclaimer, the term of this patent is extended or adjusted under 35 U.S.C. 154(b) by 0 days.

(21) Appl. No.: 09/771,717

(22) Filed: Jan. 30, 2001

(65) Prior Publication Data

US 2001/0029214 A1 Oct. 11, 2001

(30) Foreign Application Priority Data

Jan. 31, 2000 (FR) ..... 00 01331

(51) Int. Cl.[7] ..... B65D 85/00; A63B 65/12
(52) U.S. Cl. ..... 473/514; 224/667; 206/315.9
(58) Field of Search ..... 473/514; 224/667, 224/919; 206/315.9, 315.91, 315.2

(56) References Cited

U.S. PATENT DOCUMENTS

| | | | | | |
|---|---|---|---|---|---|
| 3,228,445 | A | * | 1/1966 | Mayotte | 280/159 |
| 3,618,944 | A | * | 11/1971 | Myers | 473/41 |
| 4,877,166 | A | * | 10/1989 | Gelinas, Jr. | 224/223 |
| 5,238,162 | A | * | 8/1993 | LaCivita | 224/250 |
| 5,398,422 | A | * | 3/1995 | Clarkson | 33/365 |
| 6,234,307 | B1 | * | 5/2001 | Beck | 206/315.9 |

FOREIGN PATENT DOCUMENTS

| | | | |
|---|---|---|---|
| DE | 8121967 | | 12/1981 |
| FR | 1480344 | | 7/1967 |
| FR | 2748948 | A1 * | 11/1997 |

* cited by examiner

*Primary Examiner*—Paul T. Sewell
*Assistant Examiner*—M. Chambers
(74) *Attorney, Agent, or Firm*—Greenblum & Bernstein, P.L.C.

(57) ABSTRACT

Ball-carrying structure comprising a support member having at least one orifice. The support member is adapted to removably retain a ball.

7 Claims, 2 Drawing Sheets

BALL-CARRYING STRUCTURE

CROSS-REFERENCE TO RELATED APPLICATIONS

The present application claims priority under 35 U.S.C. 517 §119 of French Patent Application No. 00/01331, filed on Jan. 31, 2000, the disclosure of which is hereby incorporated by reference thereto in its entirety.

BACKGROUND OF THE INVENTION

FIELD OF THE INVENTION

This invention relates to an original structure enabling the reception of one or several balls, in particular game balls, notably with a view to storing or displaying the balls.

SUMMARY OF THE INVENTION

The ball-carrying structure according to this invention utilizes a supporting member fitted with at least one orifice of suitable diameter in order to accommodate one ball by a slightly forcible nesting motion.

The corresponding orifice(s) is (are generally circular in shape and their wall preferably flexible to enable reception and maintenance of the ball by slight deformation of the wall.

According to one embodiment, the ball-carrying structure utilizes a ring made of flexible material; this ring may be in the form of a partial cylinder.

According to another embodiment, the structure provides for a plate made of a flexible material of a few millimetres in thickness, fitted with at least one orifice for accommodating a ball; this plate may comprise a plurality of orifices for accommodating balls, of identical or different diameters according to the diameter of the balls to be accommodated.

The ball support may further comprise a system that enables hooking of the support onto a carrying support.

According to another embodiment, this support is made of a molded flexible material and comprises an orifice to enable this support to be hooked onto the carrying structure.

According to still another embodiment, the ball-carrying structure according to the invention makes up the appended member of a key-holder ring.

According to one aspect of the invention, there is provided a ball-carrying structure comprising a support member having at least one orifice, wherein the support member is adapted to retain a ball.

The support member may be adapted to removably retain the ball. The support member may have a flexible wall which is deformable. The flexible wall may be in the form of a ring. The support member may be a ring. The support member may be a flexible plate. The plate may comprise a plurality of orifices. The ball-carrying structure may further comprise a ring coupled to the support member via a hooking system. The ring may be a key ring and the hooking system may comprise a connecting link and an opening disposed in the support member. The support member may be made of a molded flexible material. The support member may be made of a molded flexible material.

The invention also provides for a ball-carrying structure comprising a key ring adapted to retain keys, a support member in the form of a ring coupled to the key ring and having at least one orifice, and at least one ball disposed in the at least one orifice, wherein the support member is adapted to retain the ball.

The support member may be adapted to removably retain the ball. The ball-carrying structure may further comprise a hooking system coupling the key ring to the support member, the hooking system comprising a connecting link and an opening disposed in the support member.

The invention is also directed to a ball-carrying structure comprising a key ring adapted to retain keys, a support member in the form of a plate coupled to the key ring and having at least one orifice, and at least one ball disposed in the at least one orifice, wherein the support member is adapted to retain the ball.

The support member may be adapted to removably retain the ball. The ball-carrying structure may further comprise a hooking system coupling the key ring to the support member, the hooking system comprising a connecting link and an opening disposed in the support member.

BRIEF DESCRIPTION OF THE DRAWINGS

The invention will be better illustrated, without any restrictions by the following description followed by embodiments, given solely for exemplification purposes and represented on the appended drawings in which.

DETAILED DESCRIPTION OF THE PRESENT INVENTION

Figure 1:
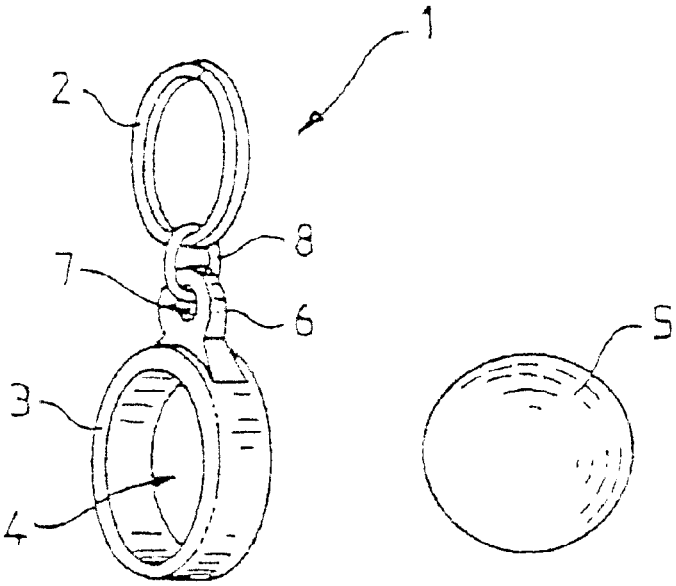
FIG. 1 is a perspective view of a ball-carrying key-holder complying with this invention, with the ball is represented as disconnected from the key-holder.
Figure 2:
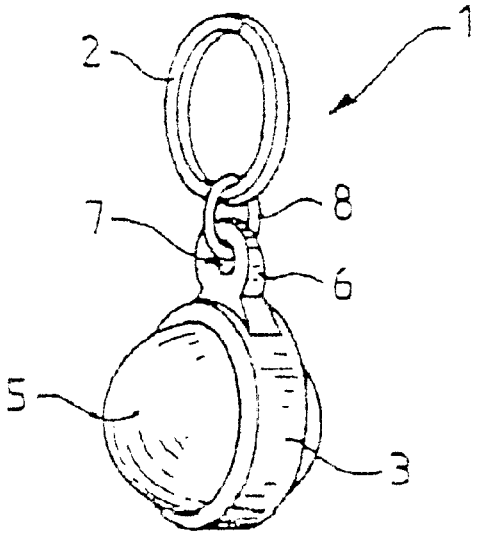
FIG. 2 shows the key-holder of FIG. 1 on which the ball is mounted.

The ball-carrying structure 1 illustrated on FIGS. 1 and 2 is in the form of a key-holder, with a ring 2 for accommodating the keys, associated with an appending member 3.

This appending member 3 utilizes a ring made of a molded flexible material (for example plastic material, latex, rubber, etc.) fitted with an orifice 4 whose diameter is suited to enable reception and slightly forcible locking of a ball 5. In the 'home'position, the diameter of the orifice is slightly less than that of the diameter of the bell 5.

The ring 3 is in the form of a partial cylinder. The thickness of this cylinder can be in the order 2 or 3 mm; its length can be in the order of 5 mm, here, significantly less than diameter of the ball 5.

A single-block extension 6 fitted with an orifice 7 enables passing a link 8 through in order to hook the ball-carrying flexible ring 3 onto the key-holder ring 2.

Any ball diameter can be contemplated (even balls of large diameters, usually called 'marbles'), whereas the diameter of the flexible ring 3 is shaped accordingly.

The flexible wall of the orifice 4 ensures removable locking of the ball 5 so that it can be removed and repositioned at will; this flexible wall enables absorbing the small size differences of the balls associated with the manufacturing techniques implemented.

Generally, the structure of the ring 3 and the type of material used for its realisation are shaped according to the clamping and behaviour characteristics desired.

Figure 3:
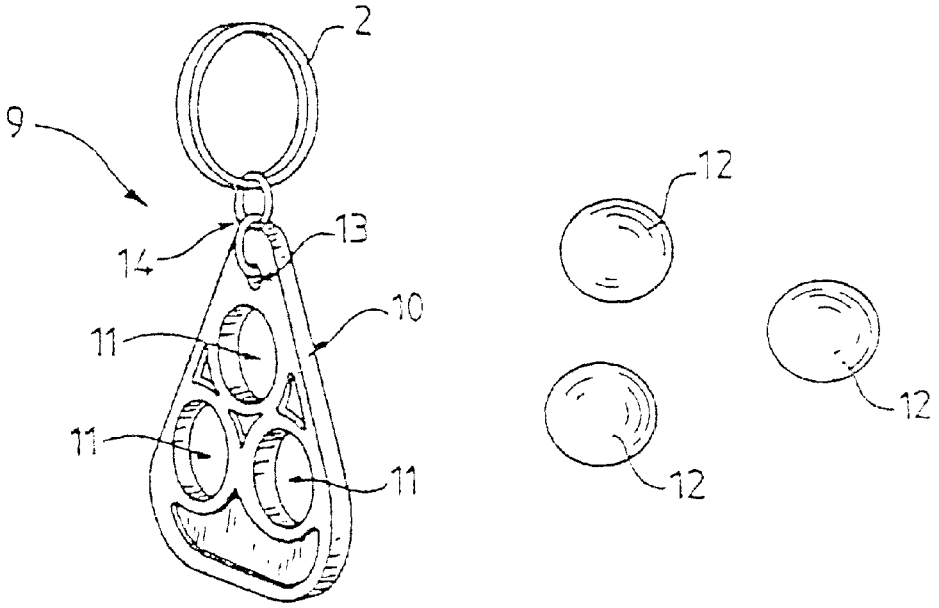
FIG. 3 is a perspective view of another possible embodiment of a ball-carrying key-holder, with the balls represented individually.
Figure 4:
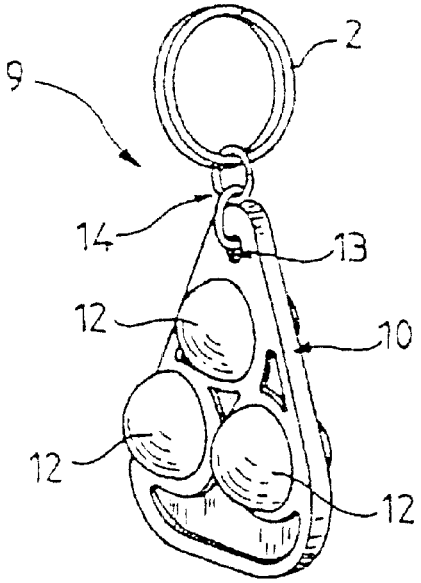
FIG. 4 shows the key-holder of FIG. 3 on which are remounted the various balls.

FIGS. 3 and 4 show another structure of a key-holder 9. Here, the appending member 10 of the key-holder ring 2 is in the shape of a triangular plate obtained by molding a flexible material, for example a plastic material, latex, rubber or other material.

This plate 10 whose thickness ranges in the order of a few millimetres, comprises three circular orifices 11 that enables slightly forcible reception of three balls 12.

The thickness of the plate 10 and the flexibility of the material used for this realisation are still suited in relation to the clamping and behaviour characteristics desired.

Obviously, the overall shape of the plate 10 can be completely different, according to the global aesthetic required, or in relation to the technical constraints associated with the number of balls that should be accommodated.

Possibly, the diameters of the orifices 12 can be different on the reception plate 10, for batter wedging of the balls or of marbles of different diameters.

FIGS. 3 and 4 underline the presence of an orifice 13 provided in the plate 10 made of flexible material, to enable hooking this plate 10 onto the ring 2 using interlocking links 14.

What is claimed is:

1. A ball-carrying structure comprising:

a support member having at least one orifice; and an opening for retaining a key chain arranged in the support member, wherein the support member removably retains a ball in the at least one orifice, wherein the ball comprises a marble having a diameter that is greater than a thickness of the support member, wherein the orifice has a diameter which is adapted to removably retain the ball via a slight forcible nesting motion, wherein the support member has a flexible wall which is deformable, and wherein the flexible wall is in the form of a ring.

2. A ball-carrying key chain structure comprising:

a support member having at least one orifice; and an opening for retaining a key chain arranged in the support member, wherein the support member removably retains a ball inside at least one orifice, wherein the ball comprises a marble having a diameter that is greater than a thickness of the support member, and wherein the support member is a ring.

3. A ball-carrying key chain structure comprising:

a support member having at least one orifice; and an opening for retaining a key chain arranged in the support member, wherein the support member removably retains a ball inside at least one orifice, wherein the ball comprises a marble having a diameter that is greater than a thickness of the support member, and wherein the support member is a flexible plate.

4. The ball-carrying structure of claim 3, wherein the plate comprises a plurality of orifices.

5. A ball-carrying structure comprising:

a key ring adapted to retain keys;

a support member in the form of a ring coupled to the key ring and having at least one orifice;

the support member having a first side and a second side; and at least one ball disposed in the at least one orifice, wherein the support member is adapted to retain the ball, and wherein the ball projects from the support member on each of the first and second sides.

6. The ball-carrying structure of claim 5, wherein the support member is adapted to removably retain the ball.

7. The ball-carrying structure of claim 5, further comprising a hooking system coupling the key ring to the support member, the hooking system comprising a connecting link and an opening disposed in the support member.

* * * * *